US009109820B2

(12) United States Patent
Michitsuji

(10) Patent No.: US 9,109,820 B2
(45) Date of Patent: Aug. 18, 2015

(54) HEAT EXCHANGE DEVICE AND COMMUNICATION TUBE USED IN THE SAME

(75) Inventor: Yoshiharu Michitsuji, Sakai (JP)

(73) Assignee: DAIKIN ONDUSTRIES, LTD., Osaka (JP)

( * ) Notice: Subject to any disclaimer, the term of this patent is extended or adjusted under 35 U.S.C. 154(b) by 311 days.

(21) Appl. No.: 13/637,612

(22) PCT Filed: Mar. 18, 2011

(86) PCT No.: PCT/JP2011/056567
§ 371 (c)(1),
(2), (4) Date: Sep. 26, 2012

(87) PCT Pub. No.: WO2011/135946
PCT Pub. Date: Nov. 3, 2011

(65) Prior Publication Data

US 2013/0014540 A1 Jan. 17, 2013

(30) Foreign Application Priority Data

Apr. 28, 2010 (JP) ..... 2010-103424

(51) Int. Cl.

| | |
|---|---|
| ***F25B 39/02*** | (2006.01) |
| ***F25B 41/00*** | (2006.01) |
| ***F28F 9/02*** | (2006.01) |
| ***F28F 9/16*** | (2006.01) |
| ***F28F 9/18*** | (2006.01) |
| *F28D 21/00* | (2006.01) |

(52) U.S. Cl.
CPC ..... *F25B 39/02* (2013.01); *F25B 41/00* (2013.01); *F28F 9/0282* (2013.01); *F28F 9/165* (2013.01); *F28F 9/185* (2013.01); *F28D 2021/0068* (2013.01); *F28D 2021/0071* (2013.01); *F28F 2210/02* (2013.01)

(58) Field of Classification Search
CPC ..... F25B 39/02; F25B 39/022; F28F 9/0224
USPC ..... 62/515, 524, 525; 165/173, 174
See application file for complete search history.

(56) References Cited

U.S. PATENT DOCUMENTS

| | | | | |
|---|---|---|---|---|
| 3,125,161 | A * | 3/1964 | Romanos | 165/159 |
| 4,276,928 | A * | 7/1981 | Blaskowski | 165/82 |
| 2009/0065185 | A1 | 3/2009 | Jekerle | |

FOREIGN PATENT DOCUMENTS

| | | |
|---|---|---|
| FR | 1 026 716 A | 4/1953 |
| JP | 61-60073 U | 4/1986 |
| JP | 61-74074 U | 5/1986 |

(Continued)

*Primary Examiner* — Melvin Jones
(74) *Attorney, Agent, or Firm* — Birch, Stewart, Kolasch & Birch, LLP

(57) ABSTRACT

A heat exchange device includes a heat exchanger having a plurality of heat transfer tubes through which a refrigerant is circulated and functioning as an evaporator, a plurality of communication tubes connected to ends of the heat transfer tubes on the refrigerant discharge side, and a header connected to ends of the plurality of communication tubes on the refrigerant discharge side, the header for joining the refrigerant discharged from the communication tubes. At least a part of the plurality of communication tubes includes a flow passage enlargement communication tube formed in such a manner that a flow passage sectional area on the side of the header is larger than a flow passage sectional area on the side of the heat transfer tubes.

6 Claims, 11 Drawing Sheets

(56) References Cited

FOREIGN PATENT DOCUMENTS

| | | | |
|---|---|---|---|
| JP | 2-97859 | A | 4/1990 |
| JP | 3-79056 | U | 8/1991 |
| JP | 10-267469 | A | 10/1998 |
| JP | 2003-166791 | A | 6/2003 |
| JP | 2005-207615 | A | 8/2005 |
| WO | WO 2007/082515 | A1 | 7/2007 |

* cited by examiner (a)

(b)

| ENLARGEMENT RATIO | CIRCULATION AMOUNT (kg/h) | DIFFERENTIAL PRESSURE (kPa) | MAGNITUDE OF PRESSURE LOSS |
|---|---|---|---|
| 100.0% | 263.9 | 452.1 | 100.0% |
| 112.5% | 263.9 | 449.9 | 99.5% |
| 125.0% | 263.9 | 445.3 | 98.5% |
| 137.5% | 263.9 | 437.6 | 96.8% |
| 150.0% | 263.9 | 425.0 | 94.0% |

HEAT EXCHANGE DEVICE AND COMMUNICATION TUBE USED IN THE SAME

TECHNICAL FIELD

The present invention relates to a heat exchange device utilized in an air conditioning device and the like, and a communication tube used in the same.

BACKGROUND ART

The air conditioning device includes a heat exchanger for performing heat exchange between the air in a room and a refrigerant in order to adjust a temperature in the room. There is a known heat exchanger in which a plurality of heat transfer tubes (refrigerant flow passages) is arranged in plural steps in the up and down direction, one end sides of the heat transfer tubes are respectively connected to a refrigerant flow divider via flow division capillaries, while the other end sides of the heat transfer tubes are respectively connected to a header via communication tubes (refer to Patent Literature 1). In a case where this heat exchanger functions as an evaporator, the refrigerant flows from the refrigerant flow divider to the heat transfer tubes via the flow division capillaries, performs the heat exchange with the air while flowing through the heat transfer tubes so as to become a gas refrigerant, and flows and joins into the header via the communication tubes and then is suctioned by a compressor.

CITATION LIST

Patent Literature

Patent Literature 1: Japanese Unexamined Patent Publication No. 10-267469

SUMMARY OF INVENTION

Technical Problem

In the heat exchanger as described above, the header is formed so as to have an inner diameter which is about 2 to 4 times larger than the heat transfer tubes and the communication tubes. When the refrigerant flows into the header from the heat transfer tubes through the communication tubes, the flow passage is radically enlarged. Such radical enlargement of the flow passage naturally causes a pressure loss of the refrigerant. When the refrigerant flows in the communication tubes at high flow speed and joins in the header, the pressure loss is also easily caused. Such a pressure loss of the refrigerant causes a decrease in suction pressure of the compressor, so as to invite deterioration of energy efficiency due to an increase in an operation load of the compressor (decrease in COP (coefficient of performance)). In recent years, there is a tendency that a diameter of the heat transfer tubes is decreased and accordingly, a diameter of the communication tubes is decreased. Thus, a problem of the pressure loss described above becomes more remarkable.

Therefore, in consideration with the above problem, an object of the present invention is to provide a heat exchange device for suppressing a pressure loss of a refrigerant flowing from communication tubes into a header and improving energy efficiency or the like, and a communication tube used in the same.

Solution to Problem

A heat exchange device according to a first aspect of the present invention includes a heat exchanger having a plurality of heat transfer tubes through which a refrigerant is circulated and functioning as an evaporator, a plurality of communication tubes connected to ends of the heat transfer tubes on the refrigerant discharge side, and a header connected to ends of the plurality of communication tubes on the refrigerant discharge side, the header for joining the refrigerant discharged from the communication tubes, wherein at least a part of the plurality of communication tubes includes a flow passage enlargement communication tube formed in such a manner that a flow passage sectional area on the side of the header is larger than a flow passage sectional area on the side of the heat transfer tubes.

With such a configuration, a flow passage of the refrigerant is enlarged in a process of reaching from the heat transfer tubes to the header, so that a pressure loss of the refrigerant due to radical enlargement of the flow passage between the communication tubes and the header, and a pressure loss due to the refrigerant flowing in the communication tubes at high speed and joining in the header can be suppressed.

It should be noted that although all the plurality of communication tubes is more favorably the flow passage enlargement communication tubes, with a part of the communication tubes being the flow passage enlargement communication tube, the pressure loss of the refrigerant can be suppressed in the entire heat exchange device.

In the above configuration, when the flow passage sectional area on the side of the heat transfer tubes in the flow passage enlargement communication tube is A, and the flow passage sectional area on the side of the header is B, A and B preferably satisfy a relationship of the following equation:

$B/A>1.1$ (wherein $B \leq C$ ($C$: flow passage sectional area of header)).

By setting the flow passage sectional area A on the side of the heat transfer tubes in the flow passage enlargement communication tube and the flow passage sectional area B on the side of the header into the relationship of the above equation, the pressure loss of the refrigerant can be effectively suppressed.

Preferably, the flow passage enlargement communication tube includes a plurality of branch tubes connected to the heat transfer tubes, and a joining tube connected to the side of the header, the joining tube for joining the refrigerant flowing through the plurality of branch tubes, and a flow passage sectional area of the joining tube is larger than the sum of flow passage sectional areas of the plurality of branch tubes.

By using such a flow passage enlargement communication tube, the pressure loss of the refrigerant flowing into the header can be favorably suppressed. In comparison to a case where the same number of flow passage enlargement communication tubes as the heat transfer tubes are connected to the header, a connection point of the flow passage enlargement communication tube to the header is reduced. Thus, the heat exchange device is more easily manufactured.

In the flow passage enlargement communication tube having the joining tube and the plurality of branch tubes, the joining tube may be formed to be longer than the branch tubes.

By forming the joining tube having the larger flow passage sectional area to be long in such a way, a range that flow speed of the refrigerant is lowered can be extended, so that an effect of suppressing the pressure loss of the refrigerant can be more enhanced.

In the flow passage enlargement communication tube having the joining tube and the plurality of branch tubes, at least the joining tube may be formed integrally with the header.

An inner diameter of the flow passage enlargement communication tube may be gradually enlarged in a tapered shape from the side of the heat transfer tubes to the side of the header.

With such a configuration, the flow passage sectional area of the flow passage enlargement communication tube can be gradually enlarged without being radically changed, so that the pressure loss of the refrigerant flowing through the flow passage enlargement communication tube can be favorably suppressed.

An inner diameter of the flow passage enlargement communication tube may be gradually enlarged in a stepwise manner from the side of the heat transfer tubes to the side of the header.

With such a configuration, the flow passage sectional area of the flow passage enlargement communication tube can be gradually enlarged without being radically changed, so that the pressure loss of the refrigerant at the time of flowing through the flow passage enlargement communication tube can be favorably suppressed.

A communication tube of a heat exchange device according to a second aspect of the present invention is provided between a heat transfer tube of a heat exchanger and a header, and forms a flow passage of a refrigerant flowing from the heat transfer tube to the header, wherein a flow passage sectional area on the side of the header is larger than a flow passage sectional area on the side of the heat transfer tubes.

Advantageous Effects of Invention

According to the present invention, the pressure loss of the refrigerant flowing into the header from the communication tubes is suppressed, so that energy efficiency can be improved.

DESCRIPTION OF EMBODIMENTS

First Embodiment

Figure 1:
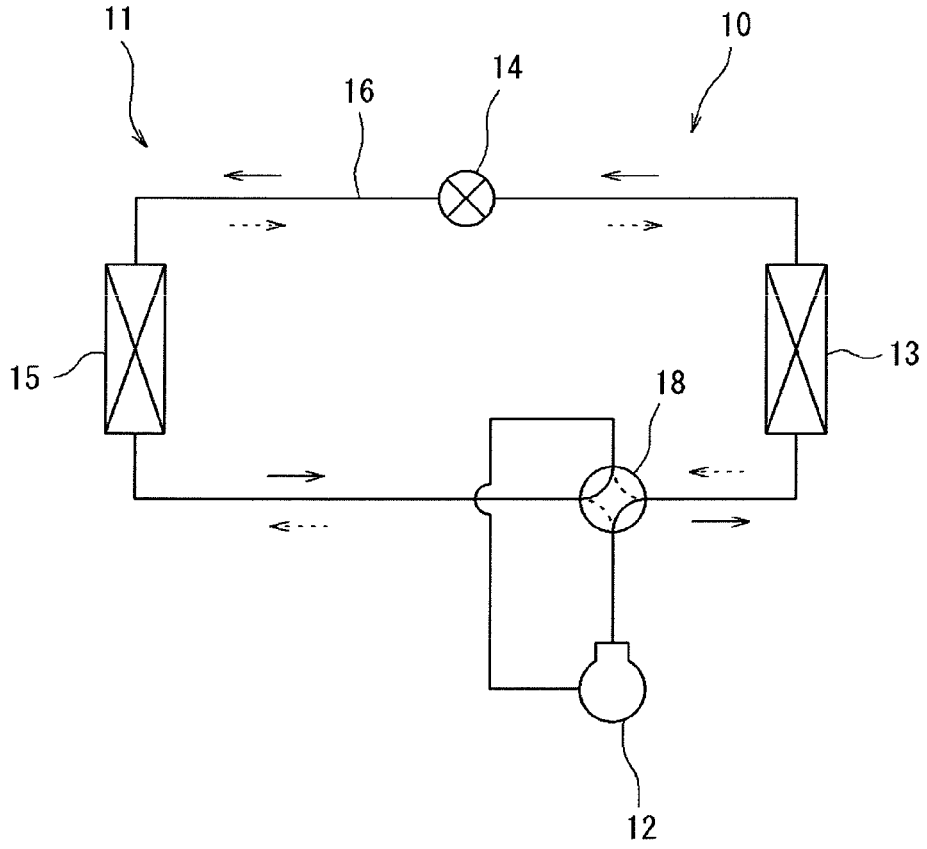
FIG. 1 is a configuration diagram showing an air conditioning device including a heat exchange device according to a first embodiment of the present invention.

FIG. 1 is a configuration diagram showing an air conditioning device 10 including a heat exchange device according to a first embodiment of the present invention.

The air conditioning device 10 of FIG. 1 is provided with a refrigerant circuit 11 for performing a vapor compression type refrigeration cycle by circulating a refrigerant. The refrigerant circuit 11 is formed by successively connecting a compressor 12, a heat-source-side heat exchanger 13, an expansion mechanism (expansion valve) 14, and a utilization-side heat exchanger 15 by a refrigerant pipe 16. The compressor 12 and the heat-source-side heat exchanger 13 are built in an outdoor unit of the air conditioning device 10, and the expansion mechanism 14 and the utilization-side heat exchanger 15 are built in an indoor unit of the air conditioning device 10.

A four way valve 18 is provided in the refrigerant pipe 16. By switching this four way valve 18, the refrigerant discharged from the compressor 12 is supplied while switching the heat-source-side heat exchanger 13 and the utilization-side heat exchanger 15, so that a cooling operation and a heating operation can be switched.

Specifically, at the time of the cooling operation, by switching the four way valve 18 as shown by a solid line, the refrigerant flows in the direction shown by solid arrows. Thereby, the refrigerant discharged from the compressor 12 is supplied to the heat-source-side heat exchanger 13, and then the refrigerant passing through the expansion mechanism 14 is supplied to the utilization-side heat exchanger 15. At this time, the heat-source-side heat exchanger 13 functions as a condenser so as to condense and liquefy a high-temperature and high-pressure gas refrigerant, and the utilization-side heat exchanger 15 functions as an evaporator so as to evaporate and gasify a low-temperature and low-pressure liquid refrigerant.

At the time of the heating operation, by switching the four way valve 18 as shown by a dotted line, a flow of the refrigerant is reversed, thereby, the refrigerant discharged from the compressor 12 is supplied to the utilization-side heat exchanger 15, and then the refrigerant passing through the expansion mechanism 14 is supplied to the heat-source-side heat exchanger 13. At this time, the utilization-side heat exchanger 15 functions as a condenser so as to condense and liquefy the high-temperature and high-pressure gas refrigerant, and the heat-source-side heat exchanger 13 functions as an evaporator so as to evaporate and gasify the low-temperature and low-pressure liquid refrigerant.

Figure 2:
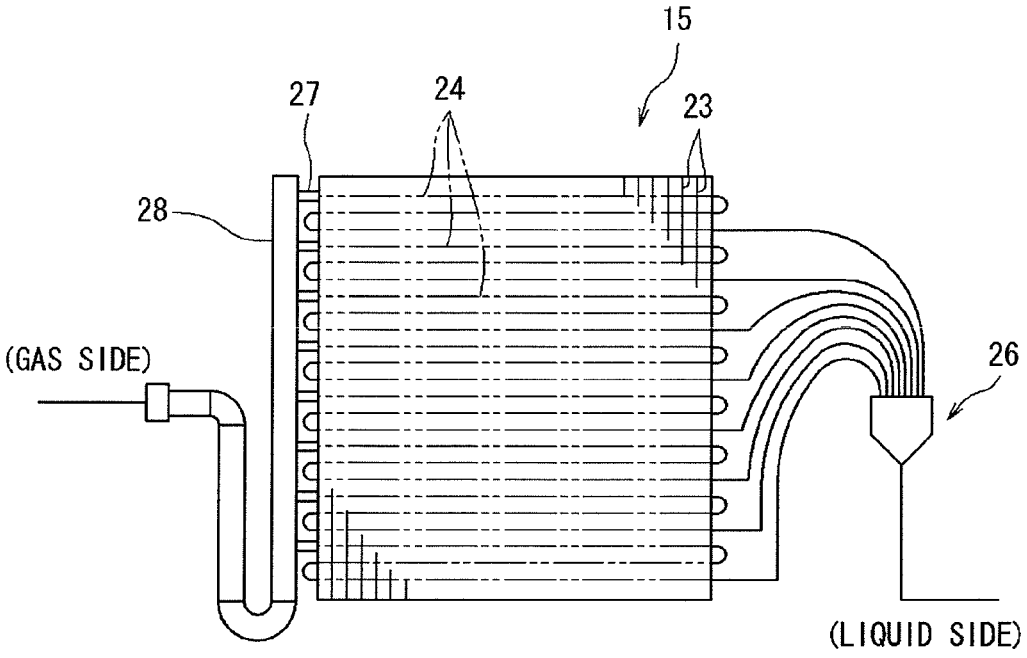
FIG. 2 is a schematic view showing a utilization-side heat exchanger (evaporator).

FIG. 2 is a schematic view showing the utilization-side heat exchanger 15. This utilization-side heat exchanger 15 is a fin and tube type heat exchanger of a so-called cross fin type, including aluminum fins 23 and copper heat transfer tubes 24. The heat transfer tubes 24 form a refrigerant flow passage through which the refrigerant flows while performing heat exchange with the air, and the plurality of heat transfer tubes is provided in line in the up and down direction in the figure. The heat transfer tubes 24 pass through the plurality of fins 23 provided in line in the left and right direction in an orthogonal manner, and are bent by about 180 degrees on both sides in the left and right direction so as to extend in a zigzag manner.

A flow divider 26 for dividing one refrigerant flow passage into a plurality of refrigerant flow passages is connected to liquid side ends of the heat transfer tubes 24. A header 28 is connected to gas side ends of the heat transfer tubes 24 via communication tubes 27 (hereinafter, also referred to as the "flow passage enlargement communication tubes", in other words, the "enlarged passage communication tubes"). At the time of the cooling operation, the refrigerant passes through the heat transfer tubes 24 of the utilization-side heat exchanger 15 functioning as the evaporator so as to be evaporated and gasified, and passes through the communication tubes 27 and joins in the header 28.

Figure 3:
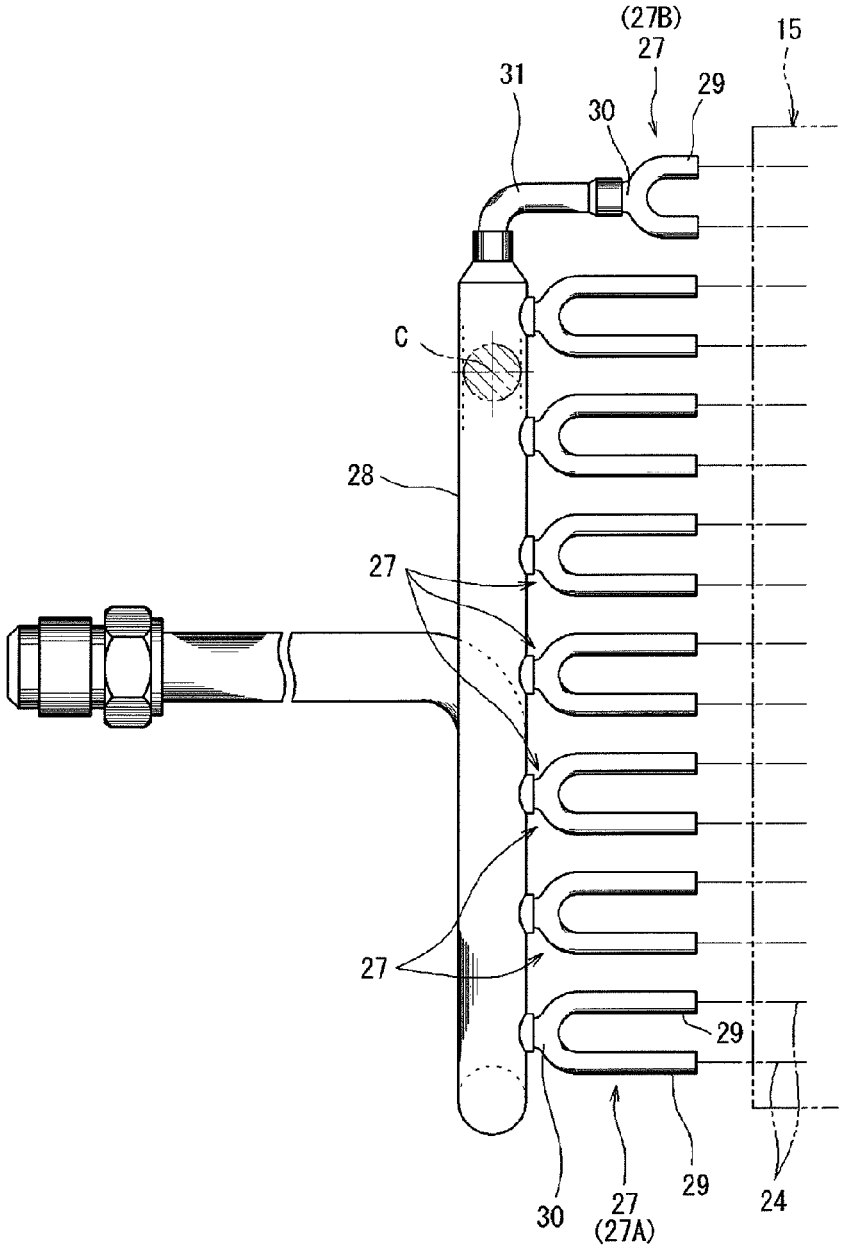
FIG. 3 is a front view of a header device.

FIG. 3 is a front view showing one example of the communication tubes 27 and the header 28.

The communication tube 27 in the present embodiment is formed in a bifurcated shape by two branch tubes 29 and one joining tube 30. The two branch tubes 29 of the communication tube 27 are respectively connected to the heat transfer tubes 24 of the heat exchanger 15, and the joining tube 30 is connected to the header 28. Some communication tube 27 has long branch tubes 29 (shown by the reference sign 27A) and the other communication tube 27 has short branch tubes 29 (shown by the reference sign 27B). The joining tube 30 of the communication tube 27B having short branch tubes 29 is connected to an axial end of the header 28 via an extension tube 31.

Sixteen heat transfer tubes 24 are provided in the up and down direction in the heat exchanger 15 shown in the figure, and eight communication tubes 27 are connected to these heat transfer tubes 24. In such a way, by using the bifurcated shape communication tubes 27, connection points of the communication tubes 27 to the header 28 can be reduced less than the number of the heat transfer tubes 24. Therefore, a processing (boring) point of the header 28 and the connection points of the communication tubes 27 to the header 28 are reduced, so that a processing task and a connection task of these parts can be performed in a short time.

Figure 4:
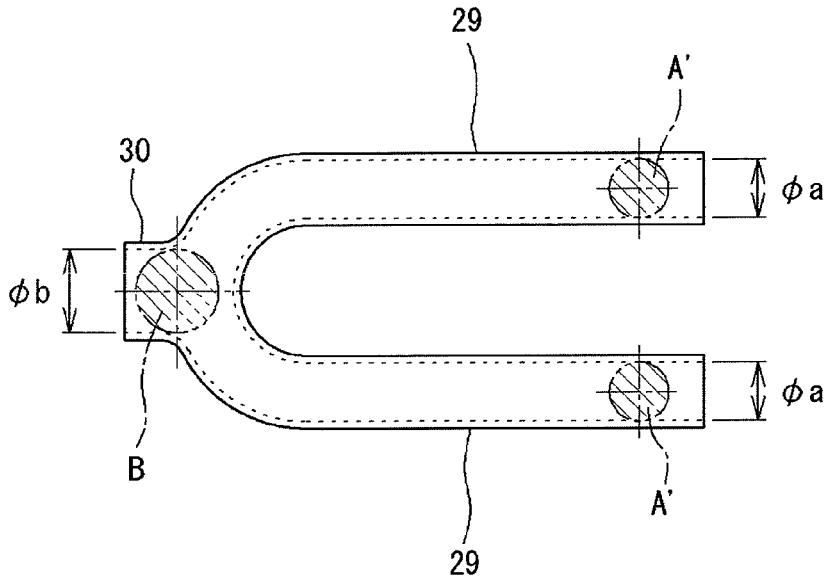
FIG. 4 is a front view of a communication tube.

FIG. 4 is an enlarged front view of the communication tube 27. In this figure, the two branch tubes 29 are formed in a straight line form on the side of the heat transfer tubes 24 (on the right side of the figure), and bent in the direction in which the branch tubes comes close to each other so as to join together on the side of the header 28. The two branch tubes 29 have the same inner diameter $\phi a$ as each other. The communication tube 27 is formed in such a manner that the inner diameter $\phi a$ of the branch tube 29 is smaller than an inner diameter $\phi b$ of the joining tube 30. Further, the communication tube 27 is formed in such a manner that the sum of flow passage sectional areas A' of the two branch tubes 29 is smaller than a flow passage sectional area B of the joining tube 30. The communication tube 27 is formed in such a manner that the flow passage sectional area B of the joining tube 30 is smaller than a flow passage sectional area C of the header 28 (refer to FIG. 3).

For example, the inner diameter $\phi a$ of the branch tube 29 is 4 mm, and the inner diameter $\phi b$ of the joining tube 30 is 6 mm. In this case, the flow passage sectional area A' of the branch tube 29 is $4\pi$ ($mm^2$: $\pi$ is a circumference ratio. Hereinafter, the same will be applied), the sum A of the flow passage sectional areas A' of the two branch tubes 29 is $A=2A'=8\pi$. Meanwhile, the flow passage sectional area B of the joining tube 30 is $9\pi$, which is larger than the sum A of the flow passage sectional areas A' of the two branch tubes 29. An enlargement ratio serving as a ratio of the flow passage sectional area B of the joining tube 30 relative to the sum A of the flow passage sectional areas A' of the branch tubes 29 is $9\pi/8\pi\times100=112.5\%$. It should be noted that an inner diameter of the header 28 is for example 14 mm, and the flow passage sectional area C of the header 28 is $49\pi$.

With the above configuration, the refrigerant flowing through the heat transfer tubes 24 of the heat exchanger 15 flows into the header 28 through the communication tubes 27 in which the flow passage on the side of the header 28 is enlarged. Therefore, a pressure loss due to radical enlargement of the flow passage sectional area at the time of flowing into the header 28 is suppressed. In the refrigerant, by lowering flow speed while flowing through the communication tubes 27, the pressure loss is suppressed. In the refrigerant, by joining in the header 28 in a state that the flow speed is lowered, the pressure loss is also suppressed. Therefore, a decrease in suction pressure of the compressor 12 at the time of the cooling operation can be suppressed, so as to suppress deterioration of energy efficiency due to an increase in an operation load (mechanical power) of the compressor 12 and a decrease in COP.

It should be noted that the heat-source-side heat exchanger 13 can be formed as well as the utilization-side heat exchanger 15. In this case, at the time of the heating operation when the heat-source-side heat exchanger 13 functions as the evaporator, the pressure loss of the refrigerant flowing into the header from the heat transfer tubes via the communication tubes can be favorably suppressed.

Second Embodiment

Figure 5:
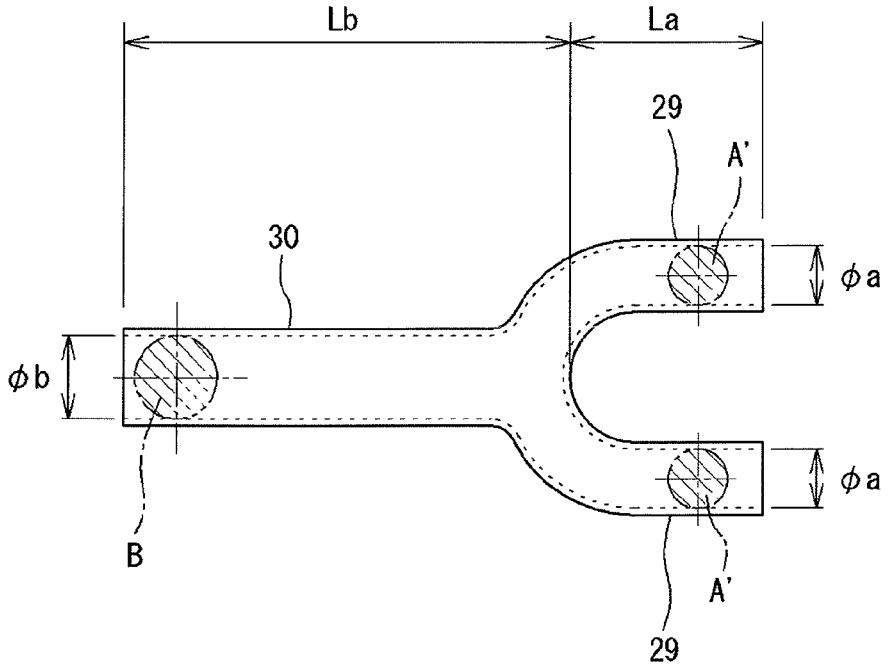
FIG. 5 is a front view of the communication tube in a second embodiment of the present invention.

FIG. 5 is a front view of the communication tube 27 in a second embodiment of the present invention. It should be noted that FIG. 5 and FIGS. 6 to 10 described later mainly show the communication tube 27 among the heat exchange device for easy understanding.

The communication tube (flow passage enlargement communication tube) 27 in the present embodiment is formed in a bifurcated shape as well as the communication tube 27 of the first embodiment (refer to FIG. 4). However, the present embodiment is different from the first embodiment in a point that axial length Lb of the joining tube 30 is longer than length La of the branch tube 29. It should be noted that in the present description, regarding the flow direction of the refrigerant, a position where the plurality of branch tubes 29 starts joining (start position) is set as a boundary position between the branch tubes 29 and the joining tube 30.

The present embodiment has the same operation and effect as the first embodiment described above. Further, since the joining tube 30 is formed to be longer than the branch tubes 29, the range that the flow speed of the refrigerant is lowered can be extended, so that an effect of suppressing the pressure loss can be more enhanced.

It should be noted that as in the communication tube 27B connected to the uppermost part of the header 28 shown in FIG. 3, the joining tube 30 may be formed to be longer than the branch tubes 29 by connecting the extension tube 31.

Third Embodiment

Figure 6:
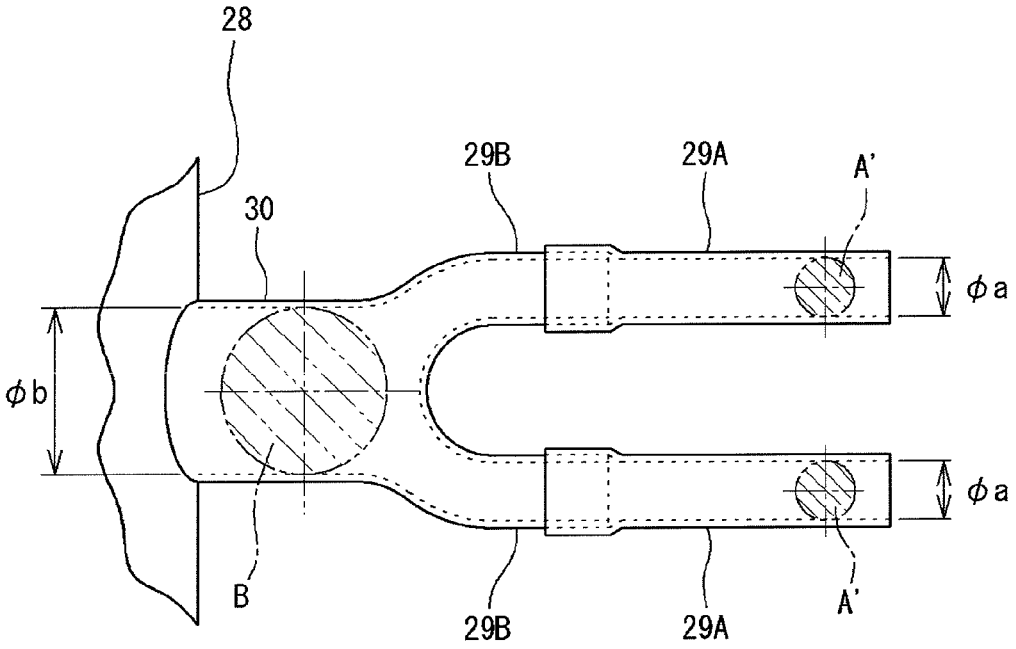
FIG. 6 is a front view of the communication tube in a third embodiment of the present invention.

FIG. 6 is a front view of the communication tube 27 in a third embodiment of the present invention.

The communication tube (flow passage enlargement communication tube) 27 in the present embodiment is formed in a bifurcated shape as well as the communication tube 27 of the first embodiment (refer to FIG. 4). However, the present embodiment is different from the first embodiment in a point that the joining tube 30 is formed integrally with the header 28. More specifically, in the communication tube 27, the branch tube 29 includes a plurality of divided tubes 29A, 29B in the axial direction. One divided tube 29B arranged on the side of the header 28 is formed integrally with the header 28 together with the joining tube 30. An end of the other divided tube 29A is flared, fitted to an end of the divided tube 29B on the side of the header 28, and fixed by brazing or the like.

The present embodiment has the same operation and effect as the first embodiment described above. In the present embodiment, as the other divided tube 29A, a straight line communication tube which is conventionally generally used can be used.

Fourth Embodiment

Figure 7:
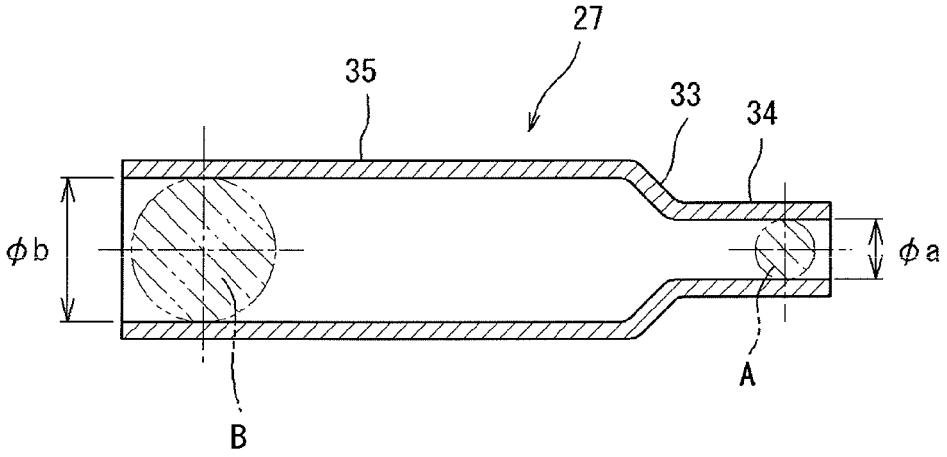
FIG. 7 is a sectional view of the communication tube in a fourth embodiment of the present invention.

FIG. 7 is a sectional view of the communication tube 27 in a fourth embodiment of the present invention.

The communication tube (flow passage enlargement communication tube) 27 in the present embodiment is not formed in a bifurcated shape unlike the communication tube 27 of the first embodiment (refer to FIG. 4) but one straight line tube. In the communication tube 27, while sandwiching a level difference portion 33 formed in the middle in the axial direction, a part on the side of the heat transfer tubes 24 (on the right side of the figure) is a small diameter portion 34 having an inner diameter $\phi a$ and a flow passage sectional area A, and a part on the side of the header 28 (on the left side of the figure) is a large diameter portion 35 having an inner diameter $\phi b$ and a flow passage sectional area B. The inner diameter $\phi a$ of the small diameter portion 34 and the inner diameter $\phi b$ of the large diameter portion 35 are in a relationship of $\phi a<\phi b$. The flow passage sectional area A of the small diameter portion 34 and the flow passage sectional area B of the large diameter portion 35 are in a relationship of A<B. With such a configuration, the pressure loss of the refrigerant flowing into the header 28 from the communication tubes 27 can be suppressed.

It should be noted that in the communication tube 27 in the present embodiment, the large diameter portion 35 is formed to be longer than the small diameter portion 34 in the axial direction. By reducing a diameter of one end of a tube material having the same inner diameter $\phi b$ as the inner diameter $\phi b$ of the large diameter portion 35 so as to form the level difference portion 33 and the small diameter portion 34, the communication tube 27 can be manufactured.

Fifth Embodiment

Figure 8:
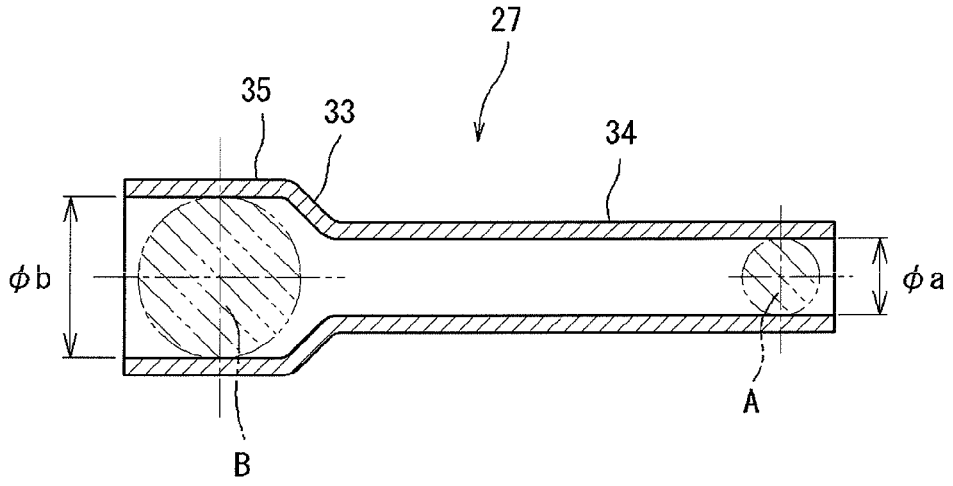
FIG. 8 is a sectional view of the communication tube in a fifth embodiment of the present invention.

FIG. 8 is a sectional view of the communication tube 27 in a fifth embodiment of the present invention.

The communication tube (flow passage enlargement communication tube) 27 in the present embodiment is one straight line tube as well as the fourth embodiment in which while sandwiching the level difference portion 33 formed in the middle in the axial direction, the side of the heat transfer tubes 24 is the small diameter portion 34 having the inner diameter $\phi a$ and the flow passage sectional area A, and the side of the header 28 is the large diameter portion 35 having the inner diameter $\phi b$ and the flow passage sectional area B. The inner diameter $\phi a$ of the small diameter portion 34 and the inner diameter $\phi b$ of the large diameter portion 35 are in the relationship of $\phi a<\phi b$. The flow passage sectional area A of the small diameter portion 34 and the flow passage sectional area B of the large diameter portion 35 are in the relationship of A<B. Therefore, in the present embodiment, the pressure loss of the refrigerant flowing into the header 28 from the communication tubes 27 can also be suppressed.

It should be noted that in the communication tube 27 in the present embodiment, the large diameter portion 35 is formed to be shorter than the small diameter portion 34 in the axial direction. By expanding a diameter of one end of a tube material having the same inner diameter $\phi a$ as the inner diameter $\phi a$ of the small diameter portion 34 so as to form the level difference portion 33 and the large diameter portion 35, the communication tube 27 can be manufactured.

Sixth Embodiment

Figure 9:
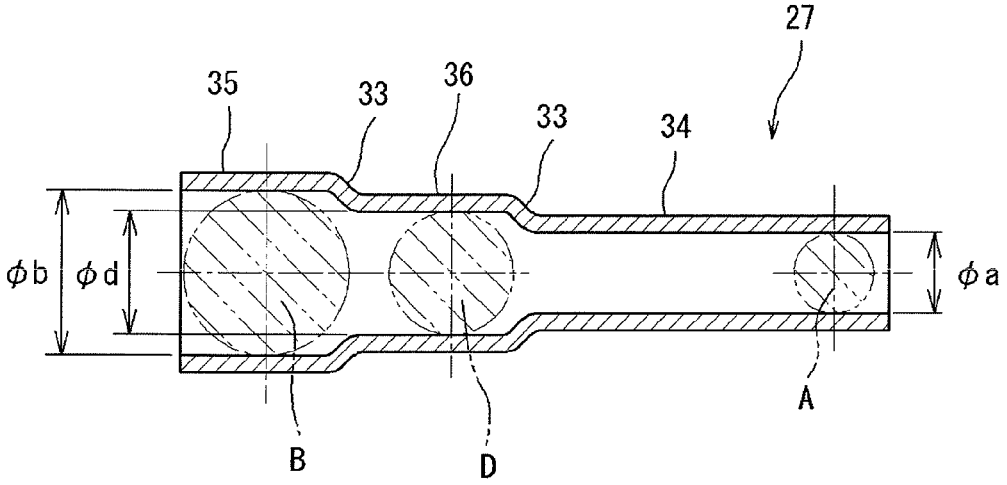
FIG. 9 is a sectional view of the communication tube in a sixth embodiment of the present invention.

FIG. 9 is a sectional view of the communication tube 27 in a sixth embodiment of the present invention.

The communication tube (flow passage enlargement communication tube) 27 in the present embodiment includes a plurality of level difference portions 33 in the axial direction, and a plurality of portions having different inner diameters while sandwiching the level difference portions 33. Specifically, the communication tube 27 has the two level difference portions 33, and the small diameter portion 34, a middle diameter portion 36, and the large diameter portion 35 are formed while sandwiching these level difference portions 33. The inner diameter $\phi a$ of the small diameter portion 34, an inner diameter $\phi d$ of the middle diameter portion 36, and the inner diameter $\phi b$ of the large diameter portion 35 are in a relationship of $\phi a<\phi d<\phi b$. The flow passage sectional area A of the small diameter portion 34, a flow passage sectional area D of the middle diameter portion 36, and the flow passage sectional area B of the large diameter portion 35 are in a relationship of A<D<B. Therefore, the flow passage sectional areas A, D, B of the communication tube 27 are gradually enlarged in a stepwise manner from the side of the heat transfer tubes 24 to the side of the header 28.

Thus, the present embodiment also has the same operation and effect as the fourth and fifth embodiments described above. Since the communication tube 27 of the present embodiment includes the plurality of level difference portions 33, a change in the inner diameter between the small diameter portion 34 and the middle diameter portion 36 and between the middle diameter portion 36 and the large diameter portion 35 can be reduced in comparison to the communication tube 27 of the fourth and fifth embodiments. Therefore, the pressure loss of the refrigerant in accordance with enlargement of the flow passage while flowing through the communication tube 27 can be suppressed.

It should be noted that the communication tube 27 having the level difference portion(s) 33 shown in the fourth to sixth embodiments can be formed by connecting a plurality of tubes having different inner diameters to each other.

Seventh Embodiment

Figure 10:
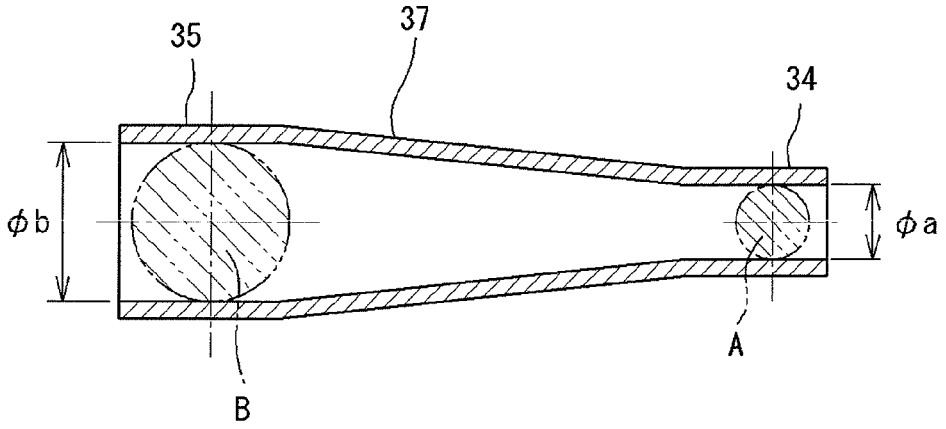
FIG. 10 is a sectional view of the communication tube in a seventh embodiment of the present invention.

FIG. 10 is a sectional view of the communication tube 27 in a seventh embodiment of the present invention.

In the communication tube (flow passage enlargement communication tube) 27 in the present embodiment, while sandwiching a taper portion 37 formed in the middle in the axial direction, the side of the heat transfer tubes 24 (right side of the figure) is the small diameter portion 34 having the inner diameter $\phi a$ and the flow passage sectional area A, and the side of the header 28 (left side of the figure) is the large diameter portion 35 having the inner diameter $c\phi b$ and the flow passage sectional area B. The taper portion 37 has axial length which is sufficiently long with respect to an inner diameter thereof. As well as the communication tube 27 of the fourth and fifth embodiments, in the communication tube 27 of the present embodiment, the inner diameter $\phi a$ of the small diameter portion 34 and the inner diameter $\phi b$ of the large diameter portion 35 are also in the relationship of $\phi a<\phi b$, and the flow passage sectional area A of the small diameter portion 34 and the flow passage sectional area B of the large diameter portion 35 are in the relationship of A<B. With such a configuration, the pressure loss of the refrigerant flowing into the header 28 from the communication tubes 27 can be suppressed. Since the flow passage sectional area is more smoothly changed by the taper portion 37 in the present embodiment, the pressure loss of the refrigerant can be more suppressed.

[Examination of Effects of the Present Invention]

Figure 11:
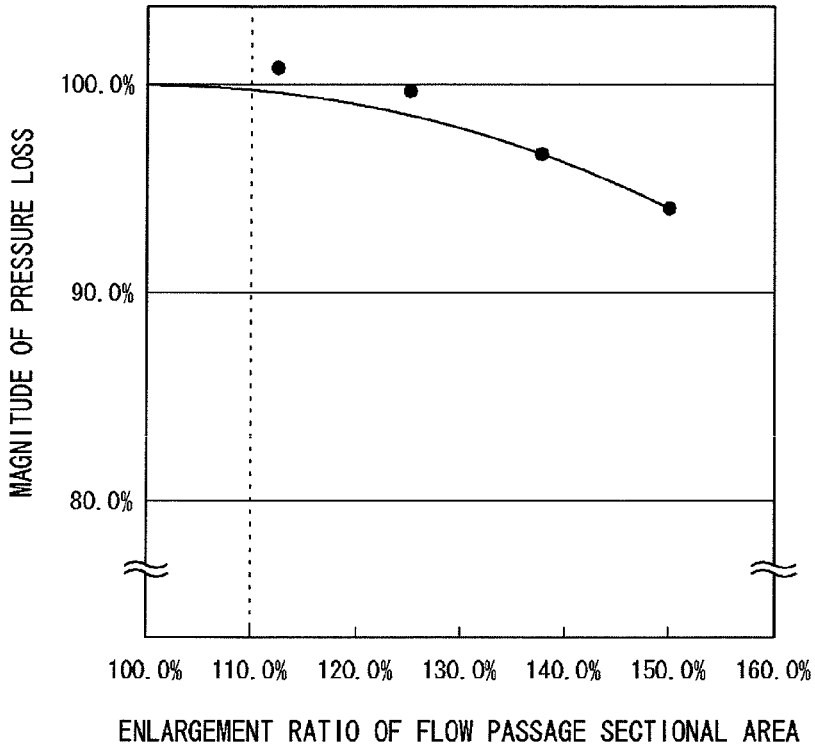
FIG. 11(*a*) is a graph showing a result that a relationship between an enlargement ratio of flow passage sectional areas of the side of heat transfer tubes and the side of a header in the communication tube and a magnitude of a pressure loss is determined by simulation, and FIG. 11(*b*) is a table showing the same result.

FIG. 11(*a*) is a graph showing a result that a relationship between the enlargement ratio of the flow passage sectional areas of the side of the heat transfer tubes 24 and the side of the header 28 in the communication tube 27 and a magnitude of the pressure loss is determined by simulation, and FIG.

11(*b*) is a table showing the same result. This simulation was performed assuming a model using the communication tube 27 of the fourth embodiment shown in FIG. 7.

In FIGS. 11(*a*) and 11(*b*), the enlargement ratio of the flow passage sectional area of the communication tube 27 is the ratio of the flow passage sectional area B on the side of the header 28 relative to the flow passage sectional area A on the side of the heat transfer tubes 24 of the communication tube 27 (B/A×100%). Differential pressure shown in FIG. 11(*b*) is a difference between pressure of the refrigerant before flowing into the flow divider 26 (refer to FIG. 2) and pressure of the refrigerant discharged from the header 28.

In FIGS. 11(*a*) and 11(*b*), regarding the magnitude of the pressure loss, when the enlargement ratio of the flow passage sectional area of the communication tube 27 is 100%, that is, when the flow passage sectional area of the communication tube 27 is fixed, the differential pressure is 100%, serving as a ratio of differential pressure $\Delta P_2$ when the enlargement ratio is changed relative to differential pressure $\Delta P_1$ when the enlargement ratio of the flow passage sectional area is 100% ($\Delta P_2/\Delta P_1 \times 100\%$).

As shown in FIGS. 11(*a*) and 11(*b*), it is found that as the enlargement ratio of the flow passage sectional area is increased, the pressure loss is reduced. Particularly, the graph of FIG. 11(*a*) shows that the pressure loss is lowered in a curve form as the enlargement ratio is increased. Thus, it is found that reduction of the pressure loss becomes remarkable roughly when the enlargement ratio exceeds 110%.

Therefore, it can be said that when the flow passage sectional area A on the side of the heat transfer tubes 24 in the communication tube 27 and the flow passage sectional area B on the side of the heat exchanger 15 satisfy a relationship of the following equation (1), the pressure loss can be more effectively suppressed.

$$B/A > 1.1 \quad (1)$$

The flow passage sectional area C of the header 28 can serve as a maximum for the flow passage sectional area B on the side of the header 28 in the communication tube 27. Therefore, the flow passage sectional area B on the side of the header 28 satisfies a relationship of the following equation (2) with respect to the flow passage sectional area C of the header 28.

$$B \leq C \quad (2)$$

However, even when the above equation (2) is satisfied, but when the enlargement ratio of the flow passage sectional area is too large, there is a possibility that the pressure loss of the refrigerant while flowing in the communication tube 27 is increased. Thus, in consideration with the result of FIG. 11, the enlargement ratio is more preferably set within a range from 120% to 150%.

The present invention is not limited to the above embodiments but a design thereof can be appropriately changed within the scope of the invention described in the claims.

For example, in the heat exchange device of the first embodiment shown in FIG. 3, all the communication tubes 27 connected to the header 28 are the flow passage enlargement communication tubes in which the flow passage sectional area B on the side of the header 28 is larger than the flow passage sectional area A on the side of the heat transfer tubes 24. However, the heat exchange device may partially include the communication tubes 27 in which the flow passage sectional areas A, B are fixed.

The heat exchange device may include two or more types of communication tubes 27 shown in FIGS. 4 to 10.

The communication tube 27 in the first to third embodiments may include three or more branch tubes 29. The joining tube 30 and the two branch tubes 29 may be arranged in a Y shape.

In the communication tube 27 in the fourth to seventh embodiments, the outer diameter may be fixed and only the inner diameter may be changed.

In the branch tubes 29 and the joining tube 30 of the communication tube 27 in the first to third embodiments, a structure of the communication tube 27 in the fourth to seventh embodiments shown in FIGS. 7 to 10 (structure having the level difference portion(s) 33 or the taper portion 37) can be applied.

The heat exchange device of the present invention can also be adopted to a heat-source-side heat exchanger functioning as the evaporator at the time of the heating operation.

REFERENCE SIGNS LIST

10: AIR CONDITIONING DEVICE
13: HEAT-SOURCE-SIDE HEAT EXCHANGER
15: UTILIZATION-SIDE HEAT EXCHANGER
24: HEAT TRANSFER TUBE
27: COMMUNICATION TUBE (FLOW PASSAGE ENLARGEMENT COMMUNICATION TUBE)
28: HEADER
29: BRANCH TUBE
30: JOINING TUBE
33: LEVEL DIFFERENCE PORTION
34: SMALL DIAMETER PORTION
35: LARGE DIAMETER PORTION
36: MIDDLE DIAMETER PORTION
37: TAPER PORTION

The invention claimed is:

1. A heat exchange device comprising a heat exchanger having a plurality of heat transfer tubes through which a refrigerant is circulated and functioning as an evaporator;

a plurality of communication tubes connected to ends of the heat transfer tubes on the refrigerant discharge side;

and a header connected to ends of the plurality of communication tubes on the refrigerant discharge side, the header for joining the refrigerant discharged from the communication tubes, wherein at least a part of the plurality of communication tubes includes a flow passage enlargement communication tube formed in such a manner that a flow passage sectional area on the side of the header is larger than a flow passage sectional area on the side of the heat transfer tubes, wherein the flow passage enlargement communication tube includes a plurality of branch tubes connected to the heat transfer tubes, and a joining tube connected to the side of the header, the joining tube for joining the refrigerant flowing through the plurality of branch tubes, and a flow passage sectional area of the joining tube is larger than the sum of flow passage sectional areas of the plurality of branch tubes.

2. The heat exchange device according to claim 1, wherein when the flow passage sectional area on the side of the heat transfer tubes in the flow passage enlargement communication tube is A, and the flow passage sectional area on the side of the header is B, A and B satisfy the following equation:

$B/A > 1.1$ (wherein $B \leq C$ (*C*: flow passage sectional area of header)).

3. The heat exchange device according to claim 1, wherein the joining tube is formed to be longer in the axial direction than the branch tubes.

4. The heat exchange device according to claim 1, wherein in the flow passage enlargement communication tube, at least the joining tube is formed integrally with the header.

5. A heat exchange device comprising a heat exchanger having a plurality of heat transfer tubes through which a refrigerant is circulated and functioning as an evaporator;

a plurality of communication tubes connected to ends of the heat transfer tubes on the refrigerant discharge side;

and a header connected to ends of the plurality of communication tubes on the refrigerant discharge side, the header for joining the refrigerant discharged from the communication tubes, wherein at least a part of the plurality of communication tubes includes a flow passage enlargement communication tube formed in such a manner that a flow passage sectional area on the side of the header is larger than a flow passage sectional area on the side of the heat transfer tubes, wherein an inner diameter of the flow passage enlargement communication tube is gradually enlarged in a stepwise manner from the side of the heat transfer tubes to the side of the header.

6. A communication tube of a heat exchange device provided between a plurality of heat transfer tubes of a heat exchanger and a header, the communication tube forming a flow passage of a refrigerant flowing from the heat transfer tube to the header, wherein a flow passage sectional area on the side of the header is larger than a flow passage sectional area on the side of the heat transfer tubes, and wherein the flow passage enlargement communication tube includes a plurality of branch tubes connected to the heat transfer tubes, and a joining tube connected to the side of the header, the joining tube for joining the refrigerant flowing through the plurality of branch tubes, and a flow passage sectional area of the joining tube is larger than the sum of flow passage sectional areas of the plurality of branch tubes.

* * * * *

UNITED STATES PATENT AND TRADEMARK OFFICE

CERTIFICATE OF CORRECTION

PATENT NO. : 9,109,820 B2
APPLICATION NO. : 13/637612
DATED : August 18, 2015
INVENTOR(S) : Yoshiharu Michitsuji It is certified that error appears in the above-identified patent and that said Letters Patent is hereby corrected as shown below:

ON THE TITLE PAGE:

At item (73), Assignee, change "DAIKIN ONDUSTRIES, LTD., Osaka (JP)" to --DAIKIN INDUSTRIES, LTD., Osaka (JP)--.

Signed and Sealed this
Eighth Day of March, 2016

Michelle K. Lee

Michelle K. Lee
*Director of the United States Patent and Trademark Office*